United States Patent [19]

Dietrich

[11] 4,089,245

[45] May 16, 1978

[54] BREAK GENERATOR

[75] Inventor: Ralph Nowack Dietrich, Jasper, Ind.

[73] Assignee: Kimball International, Inc., Jasper, Ind.

[21] Appl. No.: 731,703

[22] Filed: Oct. 12, 1976

[51] Int. Cl.[2] ..... G10H 1/00; G10H 5/00

[52] U.S. Cl. ..... 84/1.03; 84/DIG. 12

[58] Field of Search ..... 84/1.01, 1.03, 1.24, 84/DIG. 12

[56] References Cited

U.S. PATENT DOCUMENTS

| | | | |
|---|---|---|---|
| Re. 28,999 | 10/1976 | Southard | 84/1.03 |
| Re. 29,144 | 3/1977 | Bunger | 84/1.01 |
| 3,760,088 | 9/1973 | Nakada | 84/1.03 |
| 3,842,701 | 10/1974 | Robinson et al. | 84/1.03 |
| 3,889,568 | 6/1975 | Amaya | 84/1.01 |
| 3,958,483 | 5/1976 | Borrevik et al. | 84/1.03 |
| 4,020,728 | 5/1977 | Robinson et al. | 84/1.03 |

*Primary Examiner*—Stanley J. Witkowski

*Attorney, Agent, or Firm*—Albert L. Jeffers; John F. Hoffman

[57] ABSTRACT

An electronic rhythm "break" pattern generator for use with a rhythm generator of the type used with electronic organs. The break pattern generator, when operative, interrupts the flow of the normal rhythm pattern and substitutes a special rhythm pattern for one cycle of the normal rhythm pattern. The typical pattern is of a type usually played by experienced musicians at the beginning, or end, of a musical composition and form "lead-in" and "lead-out" rhythm pattern portions. The system according to the present invention can also provide for an alternate rhythm pattern at any time not limited to the beginning or end of a composition.

12 Claims, 2 Drawing Figures

BREAK GENERATOR

GENERAL BACKGROUND OF THE INVENTION

It is conventional in the art of electronic organs to provide special circuitry, often in the form of a separate unit, for the purpose of generating pulse patterns for use in special rhythm voice circuits which produce, in the main, percussion sounds which sound automatically in a predetermined rhythmic pattern. These patterns are often fairly sophisticated and complex.

The selection of patterns and voices is generally under the control of the player, with the selected pattern rhythm being initiated by depression of a single key, often a pedal key.

The automatic rhythm feature enables an average organist to concentrate on the playing of the musical portion of the music, while the selected rhythm pattern provides a pleasing background and complement to the musical portion and, furthermore, aids in maintaining the tempo of the music.

A disadvantage of the referred to arrangement is that the rhythm pattern is initiated immediately upon depression of the controlling key, or pedal, and terminates when, or shortly after, the control key, or pedal, is released. The result can be displeasing because of the abruptness of the starting and ending of the rhythm at the beginning and end of the musical composition.

The circuit herein described is designed to provide a transitional, or "break", rhythm pattern which can be used in the beginning or end of a rhythm pattern to provide a smooth beginning, or/and end, for the rhythm pattern.

Accordingly, it is an object of the present invention to provide a circuit arrangement for a rhythm device whereby an automatic rhythm pattern can be initiated and ended smoothly, by the provision of "lead-in" and/or "lead-out" of the selected rhythm pattern.

It is a further object of the present invention to provide a circuit to provide the above referred to objective which is inexpensive to build and which can be added to existing organ circuits with a minimum of modification.

A further object is the provision of a system which provides for an alternate rhythm pattern selectable at will by the organ player and for a duration selectable by the player.

BRIEF SUMMARY OF THE INVENTION

The circuit of the present invention is intended for use with a rhythm attachment, or unit, for use with electronic organs and in which circuitry is included to produce pulses at predetermined time intervals and which pulses are used to produce audible tones closely resembling standard percussion instruments normally used for rhythm music, such as drums and the like.

Tempos and particular rhythm patterns, such as waltz, etc., are selectable by the player.

When effective, the arrangement of the present invention is operable to interrupt the flow of normal rhythm pulse patterns to the rhythm voices, and to substitute therefor an alternate set of pulse patterns for one rhythm cycle of the normal pulse pattern, for example, two musical measures. The alternate pattern can be of a type like normal rhythm patterns because it is played only once. Therefore, the alternate pattern can be of a transitional nature as might be played by an experienced musician to start or terminate a complex rhythm pattern smoothly.

The alternate pattern can, of course, be used as long as desired, and where desired, during a composition at the will of the player.

The present invention establishes the alternate pulse pattern by addressing a read only memory (ROM), with one line of the ROM being addressed for each beat of the rhythm pattern. The output of the ROM is used to establish the alternate pulse patterns. The circuit and mode of operation of the present invention can best be understood by referring to the following detailed specification taken in connection with the accompanying drawings in which.

DETAILED DESCRIPTION OF THE INVENTION

In order to aid in the understanding of the circuit of the present invention, the circuit will be described as a portion of the circuit of one manual, or keyboard, of a conventional organ. The circuitry of the major portion of the organ is conventional and is not described herein in detail.

Figure 1:
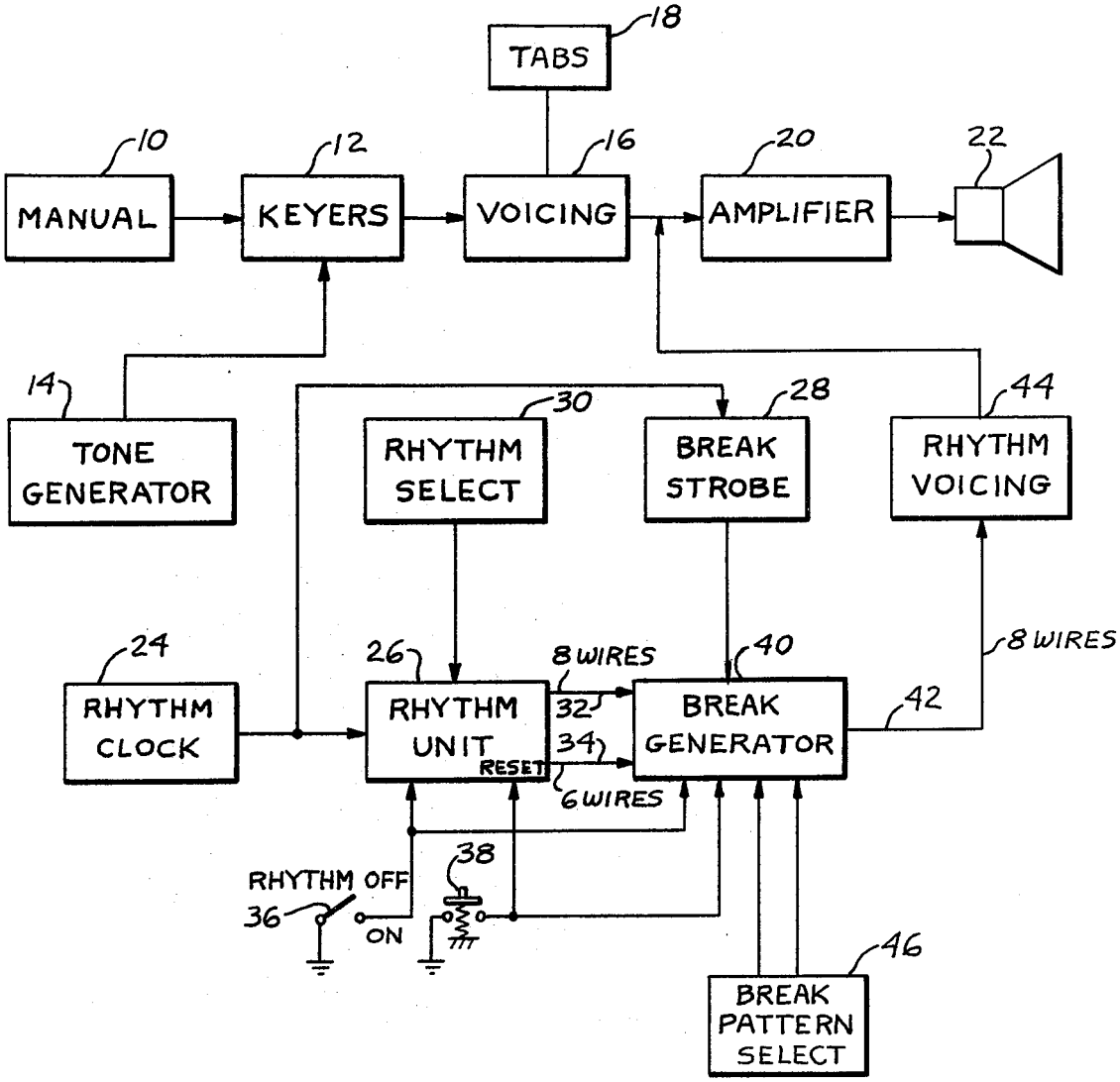
FIG. 1 is a simplified block diagram of a portion of an organ rhythm attachment circuit embodying the present invention.

Referring to FIG. 1, an organ keyboard manual 10, having playing keys, is connected to operate a group of keyers 12 to select certain ones of the outputs of tone generator 14, and to supply the selected ones of the outputs of generator 14 to voicing circuit means 16.

Voicing circuit means 16 shapes the tones from keyers 12 according to the adjustment of tab switches 18, and supplies the shaped tones via amplifier means 20 to speaker means 22.

All of the referred to circuitry associated with the manual 10 may be conventional.

Also shown in FIG. 1 is a pulse generator rhythm clock 24, of a conventional type, and which produces rhythmically timed pulses which are connected to one input of a rhythm unit 26, and, also, to the input of a "break strobe" 28, to be described hereinafter, and which produces a control pulse at the beginning of each rhythm beat.

Rhythm unit 26, which has a 6-bit counter therein, is conventional and produces, for instance, thirty-two beat, two measure, rhythm patterns. The selection of a particular pattern to be produced by rhythm unit 26 and the timing, or tempo, of the pulses produced by the pulse generator 24, is controlled by rhythm select switches 30.

The rhythm unit 26 may have eight voice outputs, shown as a single line 32 in FIG. 1, and also has the 6 bits of the rhythm counter connected as a second output, shown as a single line 34 in FIG. 1.

The rhythm unit 26 is activated when switch 36 is switched to the "ON" position. When switch 36 is in the "ON" position, the counter in the rhythm unit 26 is enabled to count, and the rhythm unit will develop pulse patterns on line 32 depending on the setting of rhythm select switches 30.

Also shown in FIG. 1 is a momentary switch 38, one side of which is grounded, while the other side is connected by one line to a reset input to rhythm unit 26, and by a second line to one input of a break generator circuit 40.

Outputs 32 (eight lines) and 34 (six lines) from rhythm unit 26 and a further line from switch 36 are also connected as inputs to circuit 40.

Circuit 40 will be operable whenever switch 36 is switched "ON" and will connect the input from line 32 of rhythm unit 26 to output line 42 of circuit 40. When switch 38 is momentarily depressed, circuit 40 will disable the input from line 32, and will, instead, develop an alternate pattern of output pulses to supply output line 42.

Also, when switch 38 is momentarily closed, the counter in rhythm unit 26 will be reset to count zero minus one. When the count on line 34 has reached 32, commencing with count zero as the first count, input line 32 to circuit 40 will be reenabled while the supply of alternate pulses from unit 40 will be disabled.

Output line 42 of circuit 40 actually consists of eight lines, with each line controlling one of eight voice circuits in the rhythm voicing group 44. Each of the rhythm voices will produce an output for each pulse supplied thereto which is connected to amplifier 20 and converted to audible sound by speaker means 22.

Circuit 40 will produce one of a predetermined set of pulse patterns when activated by depression of switch 38, the selection of which is controlled by break pattern select switches 46.

Figure 2:
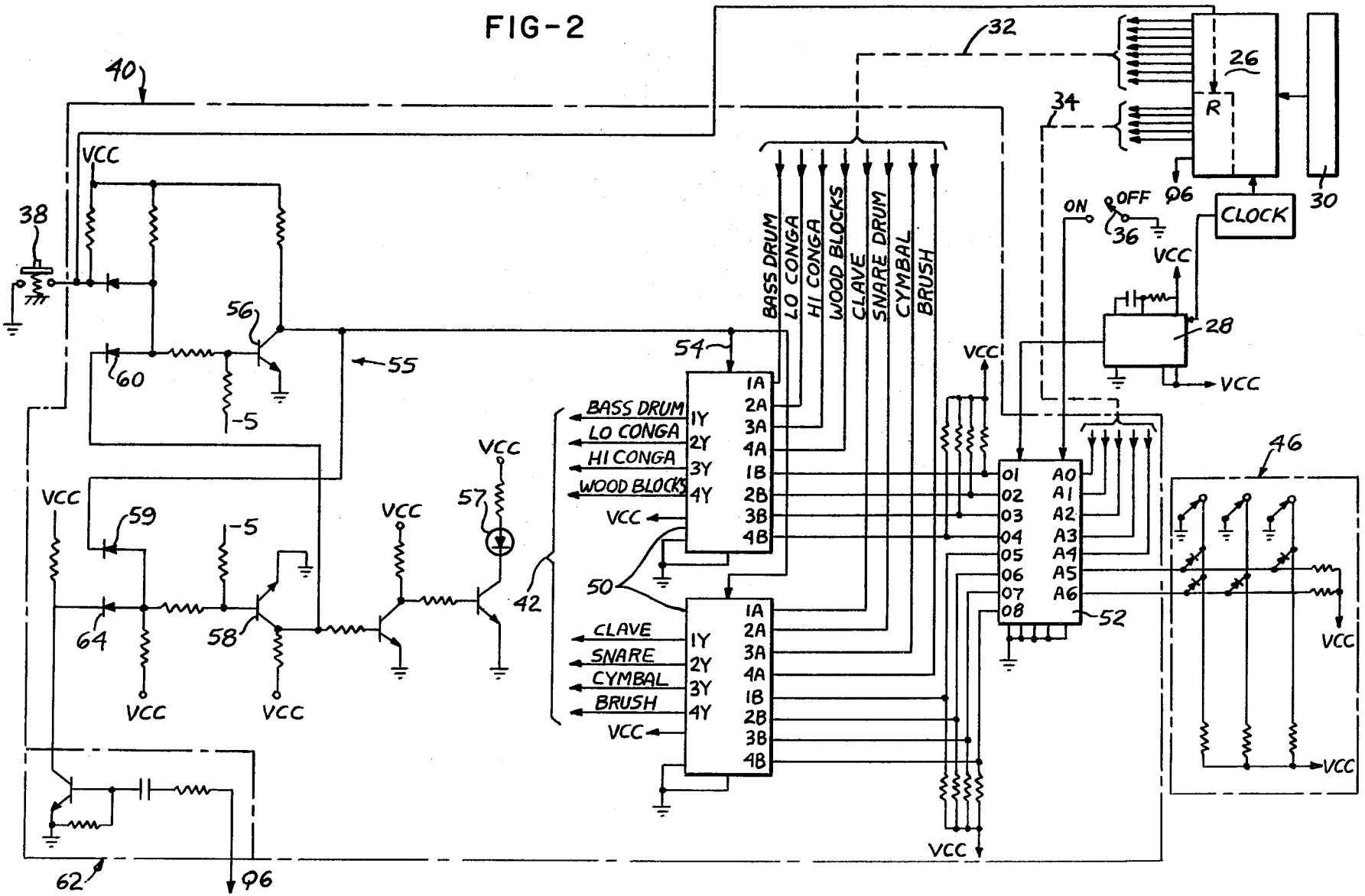
FIG. 2 is a schematic diagram of a circuit embodying the present invention.

Circuit 40 is shown in more detail in FIG. 2 wherein circuit 40 is shown within the broken line, also labeled 40, with pattern select switches 46 shown within a broken line marked 46.

Line 32, seen in FIG. 2 to be made up of eight wires, has four wires connected as an A input to each of two data selectors 50. The B inputs to selectors 50 are connected to the eight outputs of a read only memory (ROM) 52. Selectors 50 will connect either the A inputs, or the B inputs, to the corresponding outputs 1Y through 4Y of the respective selector, depending on the logic level on select input wire 54.

The output wires from the selectors 50 form a single eight wire output indicated at 42. With input wire 54 at logic level 0, selectors 50 will pass the A inputs to output wires 42, while with input wire 54 at logic level 1, selectors 50 will pass the B inputs to output wires 42.

The logic level on input wires 54 is controlled by a flip-flop 55, composed of transistors 56 and 58.

Flip-flop 55 is set when switch 38 is depressed momentarily, and which will cause transistor 56 to switch to nonconduction, and will establish a logic 1 signal on line 54. The logic 1 signal is also coupled through the diode 59 to the base of transistor 58, and will allow transistor 58 to switch to conduction. Transistor 58 will then hold transistor 56 at nonconduction through diode 60. Flip-flop 55 will remain at this state until the counter in rhythm unit 26 has counted to count thirty-two.

The $Q_6$ line is the most significant bit output and lines 34 are the least significant bit outputs of the counter in the rhythm unit 26 and on the 33rd count of the counter in the rhythm unit, the sixth counter output Q6 therefrom will switch to logic 1. The sixth counter output is coupled through a pulse forming circuit 62 and diode 64 to the base of transistor 58, and will momentarily switch transistor 58 into nonconduction. The collector of transistor 58 will then switch to logic 1, which will again allow transistor 56 to switch to conduction and establish a logic zero signal on line 54 which will hold transistor 58 in nonconduction through diode 59. Flip-flop 55 will remain in this state until switch 38 is again depressed.

The operation of flip-flop 55, as above described, will cause selectors 50 to switch from passing input 32 to output 42 to passing the outputs of ROM 52 to output 42 for one complete rhythm cycle, and then to switch back to passing input 32 to output 42.

ROM 52 will establish a series of rhythm pulses at the output terminals thereof whenever switch 36 is switched to "ON". The pulses developed by ROM 52 forms a special rhythm pattern which is developed by connecting the first five outputs, marked 34 in FIG. 2, from the counter of rhythm unit 26 to the first five addressing inputs to ROM 52. The remaining two addressing inputs to ROM 52 are connected through a diode matrix to the four pattern select switches 46.

Switches 46, when actuated, are operable to enable selected ones of four sections of ROM 52, while the 5 bits from output 34 will cause ROM 52 to cycle through each of the 32 lines of the selected section thereof.

ROM 52 will develop a series of eight bit words at the output terminals thereof on each count on counter output 34. Each of the eight outputs of ROM 52 represent one rhythm voice, and ROM 52 develops a predetermined pattern of pulses on each output terminal during a rhythm cycle.

The pulse from strobe 28, previously mentioned, forms an input to ROM 52, and is developed by a monostable multivibrator, labeled 28 in FIG. 2. The output of monostable multivibrator 28 is connected to a second input to ROM 52, and provides a signal to ROM 52 which disables the ROM at the moment when a count change is taking place in the rhythm unit counter. The pulse from strobe 28 thus prevents the development of unwanted pulses from ROM 52.

As will be seen in FIG. 2, whenever flip-flop 55 is conditioned to cause the data selectors 50 to select data from ROM 52, a signal lamp 57 will be illuminated whereas when the flip-flop is in the state in which the data selectors select data from the rhythm generator 26, lamp 57 is extinguished.

It will be apparent from the foregoing detailed description that the present invention provides for an alternate source of pulse patterns in connection with a rhythm unit which can be substantially conventional. The alternate source of rhythm patterns can be selected at will to provide, as mentioned, lead-in and lead-out terminal portions for a composition, or to provide breaks in the rhythm pattern during the composition. It will be evident, however, that the alternate source could be selected for an entire composition if so desired and, in such a case, could be interrupted briefly to provide lead-in and lead-out portions or the like from the conventional rhythm source.

It will also be apparent that the digital components referred to could operate not only in the decimal system but could operate in other systems such as the octal or hex system if so desired. Thus, it will be understood that the term "binary" where employed in the specification indicates control by the means of logic 1 and logic 0 signals whether or not a decimal system is employed.

In connection with the memory unit employed for controlling the data selects, it will be understood that any kind of settable and resettable memory arrangement could be employed. A multivibrator is illustrated, but there could also be employed type D flip flops, JK flip flops and the like, particularly if a high frequency clock signal is present.

It will further be noted that the switching on and off of the respective pulse sources can be accomplished in a number of ways other than the particular data selects illustrated. For example, if the corresponding outputs from the alternate pulse source were to be OR'd together with the outputs from the conventional rhythm source, a source of pulses could be selected merely by disabling one of the sources, or by pulling the outputs from a respective source to ground thereby permitting the other source to supply the pulses. It will, therefore, be understood that the interruption of either of the pulse sources and the establishing of the other is to be considered broadly and not to be limited to the specific circuitry shown.

Still further, a possibility is to connect the corresponding outputs of the two sources together and providing for one of the pulse sources to be in overriding relation to the other pulse source. The supply and interruption of the pulses from either source could then be controlled merely by controlling the pulses from the overriding source by either grounding the pulses out or by permitting them to override the pulses from the other source.

Modifications may be made within the scope of the appended claims.

What is claimed is:

1. A method for producing rhythm breaks in electronic organs comprising:

providing on a first output line a selected main rhythm pattern from a plurality of stored main rhythm patterns, providing on a second output line a selected rhythm break pattern from a plurality of stored rhythm break patterns, providing sequential rhythm beat signals which are in synchronism with the main rhythm pattern, selectively generating a rhythm break control signal, normally establishing a connection between the first output line and the voicing circuitry for developing shaped wave forms for supply to percussion sound output circuitry, and alternatively for interrupting the connection between the first output line and the voicing circuitry while establishing a connection between the second output line and the voicing circuitry for a selected number of rhythm beat signals when the break control signal is generated.

2. The method of claim 1 including terminating the connection between the second output line and the voicing circuitry at the end of a period of time equal to that required for one main rhythm pattern.

3. The method of claim 1 including a clock driven multiple bit binary output counter which controls the development of the main rhythm pattern and said method includes resetting the counter to a predetermined starting point when the connection of the first output line to the voicing circuitry is interrupted.

4. The method according to claim 3 in which said counter has a predetermined number of outputs and said method includes developing the selected main rhythm pattern in conformity with only the least significant bit outputs of the counter, and controlling the interruption of the connection of the first output line to the voicing circuitry when a signal change occurs on an output of greater significance.

5. A rhythm break generator for providing percussion accompaniment sounds in electronic organs comprising:

main rhythm generator means for providing on first output line means a selected main rhythm pattern from a plurality of stored main rhythm patterns, main pattern select means connected to said main generator for selecting the rhythm pattern provided by said main generator, clock means for providing rhythm beat pulses to said main generator means, break rhythm generator means for providing on second output line means a selected rhythm break pattern from a plurality of stored rhythm break patterns, said main generator means including means for providing sequential beat signals to said break generator means, said beat signals being in synchronism with said main generator means, break pattern select input means connected to said break generator means for selecting the break pattern provided by said break generator means, voicing means operable upon the supply of rhythm signals thereto to develop shaped wave forms for supply to percussion sound output circuitry, player actuated break switch means for generating a rhythm break control signal, a selector connected to said break switch means having a first input connected to said first output line means, a second input connected to said second output line means, and means for normally establishing a connection between said first input and said voicing means and alternatively for interrupting the connection between said first input and said voicing means while establishing a connection between said second input and said voicing means for a selected number of rhythm beats when a break control signal is applied to said selector.

6. The rhythm break generator of claim 5 in which said main rhythm generator means supplies pulses in conformity with a repetitive rhythmic pattern and said selective number of rhythm beats constitute at least one said repetitive pattern.

7. The rhythm break generator of claim 5 wherein said break switch means comprises:

a two state signal developing means connected to said selector for the supply of said control signal thereto, and a switch being connected in controlling relation to said signal developing means and operable when actuated to cause said signal developing means to go to a state to supply said control signal to said selector, and including means for supplying a signal to said signal developing means at the end of a predetermined period of time to return said signal developing means to its original state.

8. A rhythm break generator according to claim 5 in which said switch means is operable in response to momentary actuation thereof.

9. A rhythm break generator according to claim 5 in which said main rhythm generator means includes a clock driven counter having a multiple bit binary output, said break rhythm generator means comprises multiple section memory means connected to be addressed by outputs of said counter and each operable when addressed to develop a predetermined pattern of pulses, and selector means for enabling respective sections of said memory means to provide the output of said break rhythm generator means.

10. A rhythm break generator according to claim 5 in which said main rhythm generator means includes a clock driven multiple bit counter having a binary output and counting through all the least significant bits in developing a said main rhythm pattern, a greater significant bit output of said counter being connected to control terminal means of said selector which includes means for again establishing the connection between said first input and said voicing means when an actuating signal is present on said greater significant bit output.

11. A rhythm break generator according to claim 9 which includes strobe means for disabling said memory means for the production of output pulses during a time interval less than the time interval of a count in a rhythm pattern and spanning a change of count in said counter.

12. A rhythm break generator according to claim 5 which includes a signal lamp and means for illuminating said signal lamp only when said second input is connected to said voicing means.

* * * * *